US006295763B1

(12) United States Patent
Serba

(10) Patent No.: US 6,295,763 B1
(45) Date of Patent: Oct. 2, 2001

(54) THRESHOLD ASSEMBLY FOR A GARAGE DOOR

(76) Inventor: Henry S. Serba, 524 Linsey Ave., Schaumburg, IL (US) 60194

( * ) Notice: Subject to any disclaimer, the term of this patent is extended or adjusted under 35 U.S.C. 154(b) by 0 days.

(21) Appl. No.: 09/506,556

(22) Filed: Feb. 18, 2000

(51) Int. Cl.[7] ..... E06B 1/70

(52) U.S. Cl. ..... 49/468; 49/467; 160/40; 160/201

(58) Field of Search ..... 49/199, 200, 467, 49/468, 409, 411; 160/40, 201; 52/217, 212; 16/94 R, 100, 105, 96 R

(56) References Cited

U.S. PATENT DOCUMENTS

| | | | | |
|---|---|---|---|---|
| D. 265,686 | | 8/1982 | Smithson . | |
| 2,840,868 | | 7/1958 | May . | |
| 3,654,730 | | 4/1972 | Fraleigh . | |
| 3,667,192 | | 6/1972 | Sewell . | |
| 3,788,239 | * | 1/1974 | Bailey | 105/378 |
| 4,156,325 | * | 5/1979 | McMullen et al. | 49/468 |
| 4,198,785 | | 4/1980 | Marulic et al. . | |
| 4,688,490 | * | 8/1987 | Burleson | 105/378 |
| 4,781,270 | * | 11/1988 | Holland | 187/56 |
| 5,207,026 | * | 5/1993 | Bozeman, Jr. | 49/467 |
| 5,581,949 | | 12/1996 | Wu . | |
| 5,588,266 | * | 12/1996 | Headrick | 52/204.1 |
| 5,638,641 | * | 6/1997 | Joffe et al. | 49/469 |
| 5,967,216 | * | 10/1999 | Mancini | 160/209 |
| 6,006,814 | * | 12/1999 | Dalpe | 160/116 |
| 6,115,968 | * | 9/2000 | Sarlanis | 49/409 |
| 6,145,630 | * | 11/2000 | Friedman et al. | 187/313 |

* cited by examiner

*Primary Examiner*—Daniel P. Stodola
*Assistant Examiner*—Curtis A. Cohen

(57) ABSTRACT

A threshold assembly for a garage door for preventing moisture and air drafts from entering the garage under the garage door. The threshold assembly for a garage door includes at least one elongate base member being made of pressure treated wood; and also includes an elongate channel member being securely fastened about the at least one elongate base member; and further includes two height-adjustable mounting bracket securely attached to the ends of the at least one elongate base member and the elongate channel member and being height-adjustably mounted to the garage door track with the elongate channel member being disposed in vertical alignment with the garage door.

17 Claims, 2 Drawing Sheets

THRESHOLD ASSEMBLY FOR A GARAGE DOOR

BACKGROUND OF THE INVENTION

1. Field of the Invention

The present invention relates to a permanent threshold for a garage door and more particularly pertains to a new threshold assembly for a garage door for preventing moisture and air drafts from entering the garage under the garage door.

2. Description of the Prior Art

The use of a permanent threshold for a garage door is known in the prior art. More specifically, permanent threshold for a garage door heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 3,654,730; U.S. Pat. No. 5,581,949; U.S. Pat. No. 3,667,192; U.S. Pat. No. 4,198,785; U.S. Pat. No. 2,840,868; and U.S. Pat. No. Des. 365,686.

While these devices fulfill their respective, particular objectives and requirements, the aforementioned patents do not disclose a new threshold assembly for a garage door. The inventive device includes at least one elongate base member being made of pressure treated wood; and also includes an elongate channel member being securely fastened about the at least one elongate base member; and further includes two height-adjustable mounting bracket securely attached to the ends of the at least one elongate base member and the elongate channel member and being height-adjustably mounted to the garage door track with the elongate channel member being disposed in vertical alignment with the garage door.

In these respects, the threshold assembly for a garage door according to the present invention substantially departs from the conventional concepts and designs of the prior art, and in so doing provides an apparatus primarily developed for the purpose of preventing moisture and air drafts from entering the garage under the garage door.

SUMMARY OF THE INVENTION

In view of the foregoing disadvantages inherent in the known types of permanent threshold for a garage door now present in the prior art, the present invention provides a new threshold assembly for a garage door construction wherein the same can be utilized for preventing moisture and air drafts from entering the garage under the garage door.

The general purpose of the present invention, which will be described subsequently in greater detail, is to provide a new threshold assembly for a garage door which has many of the advantages of the permanent threshold for a garage door mentioned heretofore and many novel features that result in a new threshold assembly for a garage door which is not anticipated, rendered obvious, suggested, or even implied by any of the prior art permanent threshold for a garage door, either alone or in any combination thereof.

To attain this, the present invention generally comprises at least one elongate base member being made of pressure treated wood; and also includes an elongate channel member being securely fastened about the at least one elongate base member; and further includes two height-adjustable mounting bracket securely attached to the ends of the at least one elongate base member and the elongate channel member and being height-adjustably mounted to the garage door track with the elongate channel member being disposed in vertical alignment with the garage door.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new threshold assembly for a garage door which has many of the advantages of the permanent threshold for a garage door mentioned heretofore and many novel features that result in a new threshold assembly for a garage door which is not anticipated, rendered obvious, suggested, or even implied by any of the prior art permanent threshold for a garage door, either alone or in any combination thereof.

It is another object of the present invention to provide a new threshold assembly for a garage door which may be easily and efficiently manufactured and marketed.

It is a further object of the present invention to provide a new threshold assembly for a garage door which is of a durable and reliable construction.

An even further object of the present invention is to provide a new threshold assembly for a garage door which is susceptible of a low cost of manufacture with regard to both materials and labor, and which accordingly is then susceptible of low prices of sale to the consuming public, thereby making such threshold assembly for a garage door economically available to the buying public.

Still yet another object of the present invention is to provide a new threshold assembly for a garage door which provides in the apparatuses and methods of the prior art some of the advantages thereof, while simultaneously overcoming some of the disadvantages normally associated therewith.

Still another object of the present invention is to provide a new threshold assembly for a garage door for preventing moisture and air drafts from entering the garage under the garage door.

Yet another object of the present invention is to provide a new threshold assembly for a garage door which includes at least one elongate base member being made of pressure treated wood; and also includes an elongate channel member being securely fastened about the at least one elongate base member; and further includes two height-adjustable mounting bracket securely attached to the ends of the at least one elongate base member and the elongate channel member and being height-adjustably mounted to the garage door track with the elongate channel member being disposed in vertical alignment with the garage door.

Still yet another object of the present invention is to provide a new threshold assembly for a garage door that can be easily adjusted according to the changing conditions of the garage floor and the driveway.

Even still another object of the present invention is to provide a new threshold assembly for a garage door that essentially seals the garage door when it is in a closed position.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
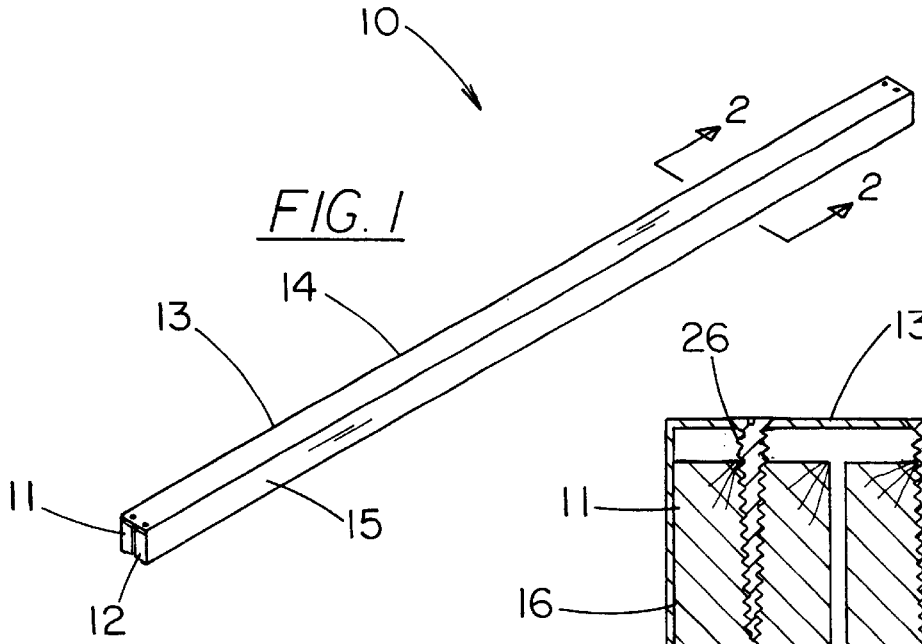
FIG. 1 is a perspective view of a new threshold assembly for a garage door according to the present invention.
Figure 2:
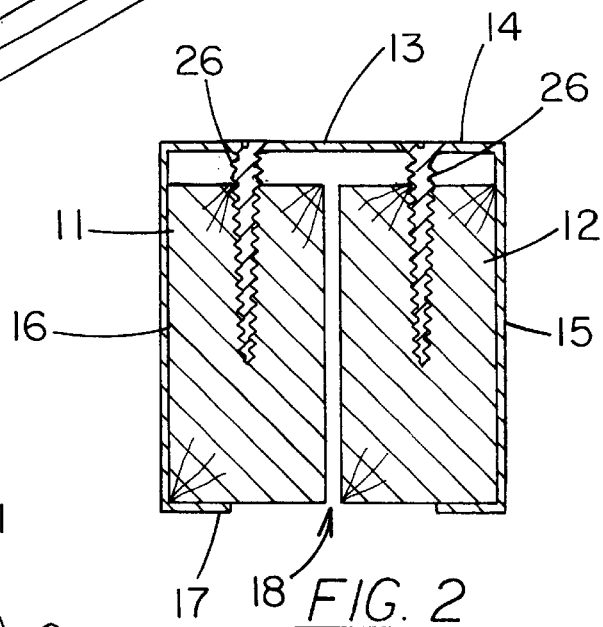
FIG. 2 is a cross-sectional view of the present invention.
Figure 3:
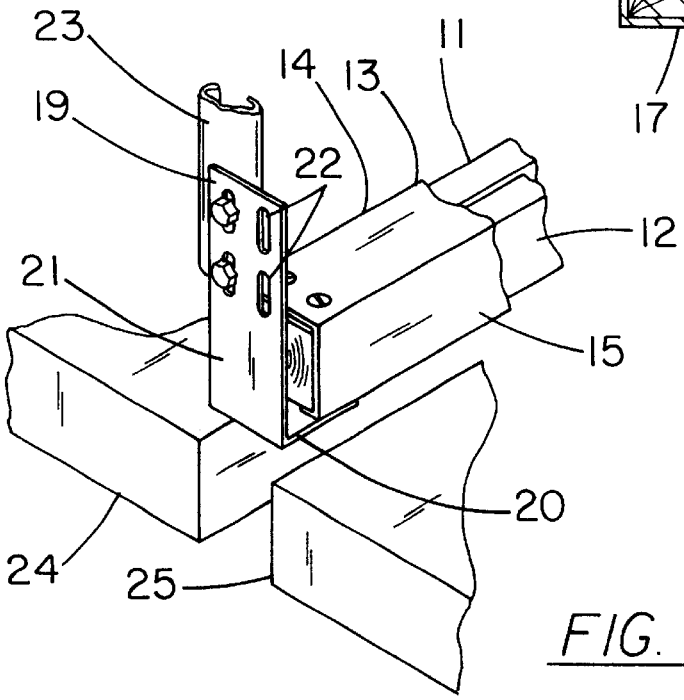
FIG. 3 is a detailed perspective view of one of the ends of the present invention.
Figure 4:
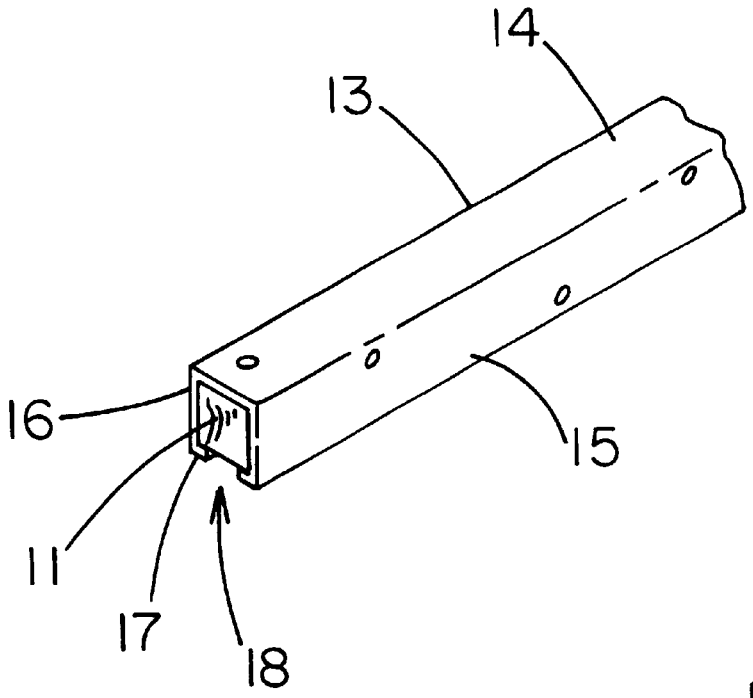
FIG. 4 is a perspective view of another embodiment of the present invention.

With reference now to the drawings, and in particular to FIGS. 1 through 4 thereof, a new threshold assembly for a garage door embodying the principles and concepts of the present invention and generally designated by the reference numeral 10 will be described.

As best illustrated in FIGS. 1 through 4, the threshold assembly for a garage door 10 generally comprises at least one elongate base member 11,12 being a solid structure; and also comprises an elongate channel member 13 having a top wall 14, side walls 15,16, a bottom wall 17 which includes a longitudinal opening 18 extending therein and extending a length thereof. The at least one elongate base member 11,12 is securely disposed and fastened in the elongate channel member 13 with fasteners 26. The elongate channel member 13 and the at least one elongate base member 11,12 are adapted to be adjustably disposed between a back end of a garage floor 24 and a front end of a driveway 25. At least one height-adjustable mounting bracket 19 is adapted to securely mount to a garage door track 23 with the elongate channel member 13 and the at least one elongate base member 11,12 being securely mounted with fasteners to the at least one height-adjustable mounting bracket 19. The at least one height-adjustable mounting bracket 19 includes a first portion 20 which is generally horizontally disposed and also includes a second portion 21 which is angled relative to the first portion 20, and further includes a plurality of holes 23 spaced apart and extending through the second portion 21 with the holes 23 being adapted to receive fasteners for adjustably mounting the at least one height-adjustable mounting bracket 19 to the garage door track 23. The at least one elongate base member 11,12 and the elongate channel member 13 has ends which are securely mounted upon the first portion 20 of the height-adjustable mounting bracket 19 with the solid structure 11,12 being essentially pressure treated wood.

As a first embodiment, the solid structure 11,12 is essentially a 2 by 4 piece of lumber which is adapted to extend a width of the garage floor 24.

As a second embodiment, the at least one elongate base member 11,12 includes a pair of 2 by 4 pieces of pressure treated lumber disposed side-by-side and being fastened with screws 26 to the top wall 14 of the elongate channel member 13.

In use, the user positions the elongate channel member 13 along with either the one piece of lumber or the two pieces of lumber between the back end of the garage floor 24 and the front end of the driveway 25 and fastens the two height-adjustable mounting brackets 19 to the garage door tracks 23 at the desired height.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An adjustable threshold assembly for a garage door structure having an opening with opposite stationary garage door tracks and a threshold extending across a lower portion of the opening, the garage door structure including a garage door, the threshold assembly comprising:

at least one elongate base member for extending across the opening of the garage door structure adjacent to the threshold;

an elongate channel member for abutting against the garage door in a lowered position of the garage door, said channel member having a top wall, side walls, a bottom wall which includes a longitudinal opening extending therein and extending a length thereof, said at least one elongate base member being securely disposed and fastened in said elongate channel member, said elongate channel member having opposite ends; and a height-adjustable mounting bracket mounted on each of the opposite ends of the channel member, each of said mounting brackets being securely mounted to a garage door track, said elongate channel and said at least one elongate base member being securely mounted to said height-adjustable mounting bracket and being adapted to be in vertical alignment with the garage door, said height-adjustable mounting bracket having adjustment means for permitting adjusting of a position of the mounting bracket on the garage door tracks in a longitudinal direction of the garage door tracks such that a position of said channel member is adjustable with respect to said garage door.

2. A threshold assembly for a garage door as described in claim 1, wherein said at least one elongate base member is a solid structure.

3. A threshold assembly for a garage door as described in claim 2, wherein said solid structure is essentially pressure treated wood.

4. A threshold assembly for a garage door as described in claim 3, wherein said solid structure is essentially a 2 by 4 piece of lumber which is adapted to extend the width of the garage floor.

5. A threshold assembly for a garage door as described in claim 4, wherein said at least one elongate base member includes a pair of 2 by 4 pieces of pressure treated lumber disposed side-by-side and being fastened with screws to said top wall of said elongate channel member.

6. A threshold assembly for a garage door as described in claim 1, wherein said elongate channel member and said at least one elongate base member are adapted to be adjustably disposed between a back end of garage floor and a front end of a driveway.

7. A threshold assembly for a garage door as described in claim 1, wherein said height-adjustable mounting brackets include a first portion which is generally horizontally disposed and also includes a second portion which is angled relative to said first portion, and further includes a plurality of holes spaced apart and extending through said second portion, said holes being adapted to receive fasteners for adjustably mounting said at least one height-adjustable mounting bracket to the garage door track.

8. A threshold assembly for a garage door as described in claim 7, wherein said first portion of said height-adjustable mounting bracket is mounted on said channel member.

9. A threshold assembly for a garage door as described in claim 1, wherein the adjustment means of each mounting bracket comprises at least one slot formed in each of the mounting brackets and a fastener extending through said slot for insertion into an aperture formed in the garage door track.

10. A threshold assembly for a garage door as described in claim 9, wherein the slot has a longitudinal axis for orienting substantially parallel to a longitudinal axis of an adjacent garage door track.

11. An adjustable threshold system, comprising:

a garage door structure having opposite stationary elongate garage door tracks extending upward from a threshold and a garage door movably mounted on the garage door tracks for movement between a lowered and a raised position, the garage door having a lower edge; and a threshold assembly comprising:

an elongate channel member for abutting the lower edge of said garage door when the garage door is positioned in the lowered position, said channel member having opposite ends mounted on the garage door tracks to extend between the garage door tracks;

an adjustable mounting bracket mounted between each of the opposite ends of the channel member and one of the garage door tracks, the adjustable mounting bracket having adjustment means for permitting adjusting of a position of the mounting bracket on the garage door tracks in a longitudinal direction of the garage door tracks such that a position of said channel member is adjustable with respect to the lower edge of said garage door.

12. The threshold system of claim 11 wherein the adjustment means of each mounting bracket comprises at least one slot formed in each of the mounting brackets, an aperture formed in the garage door track, and a fastener extending through said slot and the aperture.

13. The threshold system of claim 12 wherein the slot has a longitudinal axis oriented substantially parallel to the longitudinal axis of an adjacent one of the garage door tracks.

14. The threshold system of claim 12 wherein each of the mounting brackets has a pair of axially-aligned slots oriented substantially parallel to the longitudinal axis of the garage door track.

15. The threshold system of claim 11 wherein said channel member has a top wall, side walls, a bottom wall which includes a longitudinal opening extending therein and extending a length thereof.

16. The threshold system of claim 11 additionally comprising an elongate base member, said elongate base member being disposed in said elongate channel member.

17. The threshold system of claim 16 wherein said adjustable mounting bracket includes a first portion which is generally horizontally disposed and also includes a second portion which is angled relative to said first portion.

* * * * *